US011078788B1

(12) United States Patent
Lan

(10) Patent No.: US 11,078,788 B1
(45) Date of Patent: Aug. 3, 2021

(54) APPARATUS AND METHOD FOR SINKING CONCRETE SHAFT

(71) Applicant: ICIAN ENGINEERING CONTRACTORS CO., LTD., New Taipei (TW)

(72) Inventor: Ming-Yang Lan, New Taipei (TW)

(73) Assignee: ICIAN ENGINEERING CONTRACTORS CO., LTD., New Taipei (TW)

( * ) Notice: Subject to any disclaimer, the term of this patent is extended or adjusted under 35 U.S.C. 154(b) by 0 days.

(21) Appl. No.: 16/923,978

(22) Filed: Jul. 8, 2020

(51) Int. Cl.
*E21D 1/03* (2006.01)
*E21D 7/02* (2006.01)

(52) U.S. Cl.
CPC *E21D 1/03* (2013.01); *E21D 7/02* (2013.01)

(58) Field of Classification Search
CPC .. E02D 23/08; E21D 1/03; E21D 7/02; E21D 1/10
See application file for complete search history.

(56) References Cited

U.S. PATENT DOCUMENTS

| | | | | |
|---|---|---|---|---|
| 5,002,434 A * | 3/1991 | Massoudi | E02D 23/08 405/226 |
| 5,197,827 A * | 3/1993 | Lee | E02D 23/08 405/133 |
| 10,988,907 B1 * | 4/2021 | Lan | E02D 7/00 |
| 2012/0076591 A1 * | 3/2012 | Peters | E02D 7/28 405/228 |
| 2015/0197907 A1 * | 7/2015 | Aurora | E21B 7/12 405/211 |

FOREIGN PATENT DOCUMENTS

| | | |
|---|---|---|
| JP | 61122327 | * 6/1996 |
| JP | 2008274681 | * 11/2008 |
| JP | 2017089335 | * 5/2017 |
| TW | I507586 B | 11/2015 |

* cited by examiner

*Primary Examiner* — Carib A Oquendo
(74) *Attorney, Agent, or Firm* — Hamre, Schumann, Mueller & Larson, P.C.

(57) ABSTRACT

A shaft sinking apparatus for sinking a concrete shaft in a pit includes at least one first steel beam disposed to span the concrete shaft, two second steel beams disposed on the first steel beam, at least two tightening units configured to force the second steel beams into abutment against the first steel beam, and at least two jack members provided among the first and second steel beams. When each of the jack members is actuated, the first steel beam is driven by the jack members to move downwardly away from the second steel beams to thereby force a lower surrounding edge of the concrete shaft to sink into a bottom surface of the pit.

11 Claims, 15 Drawing Sheets

APPARATUS AND METHOD FOR SINKING CONCRETE SHAFT

FIELD

The disclosure relates to a shaft sinking apparatus for sinking a concrete shaft, more particularly to a shaft sinking apparatus for sinking a concrete shaft, and a method for sinking the concrete shaft using the apparatus.

BACKGROUND

A concrete shaft, after being sunk into the ground, may function as abridge pier or a base of a construction element. The concrete shaft may be sunk into the ground using excavation techniques, and so on.

SUMMARY

An object of the disclosure is to provide a novel shaft sinking apparatus for sinking a concrete shaft, and a novel method for sinking the concrete shaft using the apparatus.

According to a first aspect of the disclosure, a shaft sinking apparatus is provided for sinking a concrete shaft which has an upper surrounding edge and a lower surrounding edge, and which is disposed on a bottom surface of a pit beneath a working platform. The shaft sinking apparatus includes at least one first steel beam, two second steel beams, at least two first tightening units, and at least two first jack members. The first steel beam extends in a front-rear direction, and is for being disposed on the upper surrounding edge to span the concrete shaft. The second steel beams extend in a left-right direction, and are disposed on the first steel beam to be spaced apart from each other in the front-rear direction. Each of the first tightening units is configured to tighten a respective one of the second steel beams onto the first steel beam, and includes two first tightening bars and two first tightening nuts. Each of the first tightening bars has a first upper segment with a first outer threaded surface, and a first lower segment for being fastened to the working platform. The first upper segments of the first tightening bars extend in an upright direction through the respective second steel beam to have the first steel beam disposed therebetween. The first tightening nuts respectively have two first inner threaded surfaces configured to be brought respectively into threaded engagement with the first outer threaded surfaces of the first upper segments of the first tightening bars so as to force the respective second steel beam into abutment against the first steel beam. Each of the first jack members has a first cylinder which is secured in the first steel beam, and a first piston rod which is received in a respective one of the second steel beams such that when the first piston rod of each of the first jack members is actuated to extend along a first axis in the upright direction from a first retracted position to a first extended position, the first steel beam is driven by the first jack members to move downwardly away from the second steel beams, to thereby force the lower surrounding edge of the concrete shaft to sink into the bottom surface of the pit.

According to a second aspect of the disclosure, a method for sinking a concrete shaft includes the steps of:

a1) disposing the concrete shaft on a bottom surface of a pit;

a2) disposing at least one first steel beam on an upper surrounding edge of the concrete shaft to permit the first steel beam to span the concrete shaft in a front-rear direction;

a3) disposing two second steel beams, which extend in a left-right direction and which are spaced apart from each other in the front-rear direction, on the first steel beam;

a4) providing at least two first jack members each of which is in a first retracted position, and each of which has a first cylinder secured in the first steel beam, and a first piston rod received in a respective one of the second steel beams, the first piston rod being actuatable to extend along a first axis in an upright direction from the first retracted position to a first extended position;

b1) after steps a1), a2), a3, and a4), forcing the second steel beams into abutment against the first steel beam; and b2) after step b1), actuating each of the first jack members from the first retracted position to the first extended position so as to move the first steel beam downwardly away from the second steel beams, to thereby force a lower surrounding edge of the concrete shaft to sink into the bottom surface of the pit.

BRIEF DESCRIPTION OF THE DRAWINGS

Other features and advantages of the disclosure will become apparent in the following detailed description of the embodiment (s) with reference to the accompanying drawings, in which.

DETAILED DESCRIPTION

Figure 1:
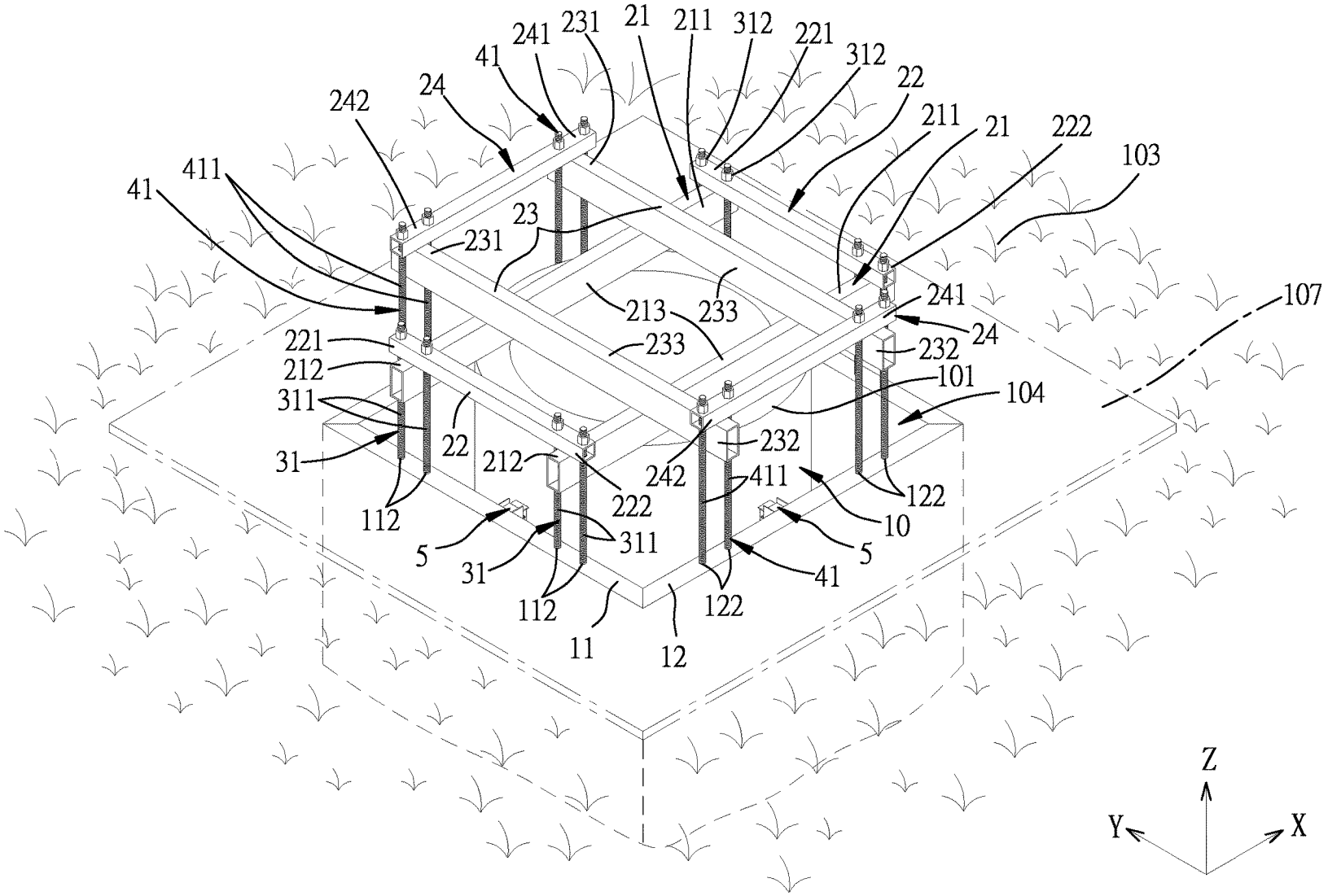
FIG. 1 is a perspective view of a shaft sinking apparatus according to an embodiment of the disclosure.

Before the disclosure is described in greater detail, it should be noted that where considered appropriate, reference numerals have been repeated among the figures to indicate corresponding or analogous elements, which may optionally have similar characteristics.

To aid in describing the disclosure, directional terms may be used in the specification and claims to describe portions of the present disclosure (e.g., front, rear, left, right, top, bottom, etc.). These directional definitions are intended to merely assist in describing and claiming the disclosure and are not intended to limit the disclosure in any way.

Figure 2:
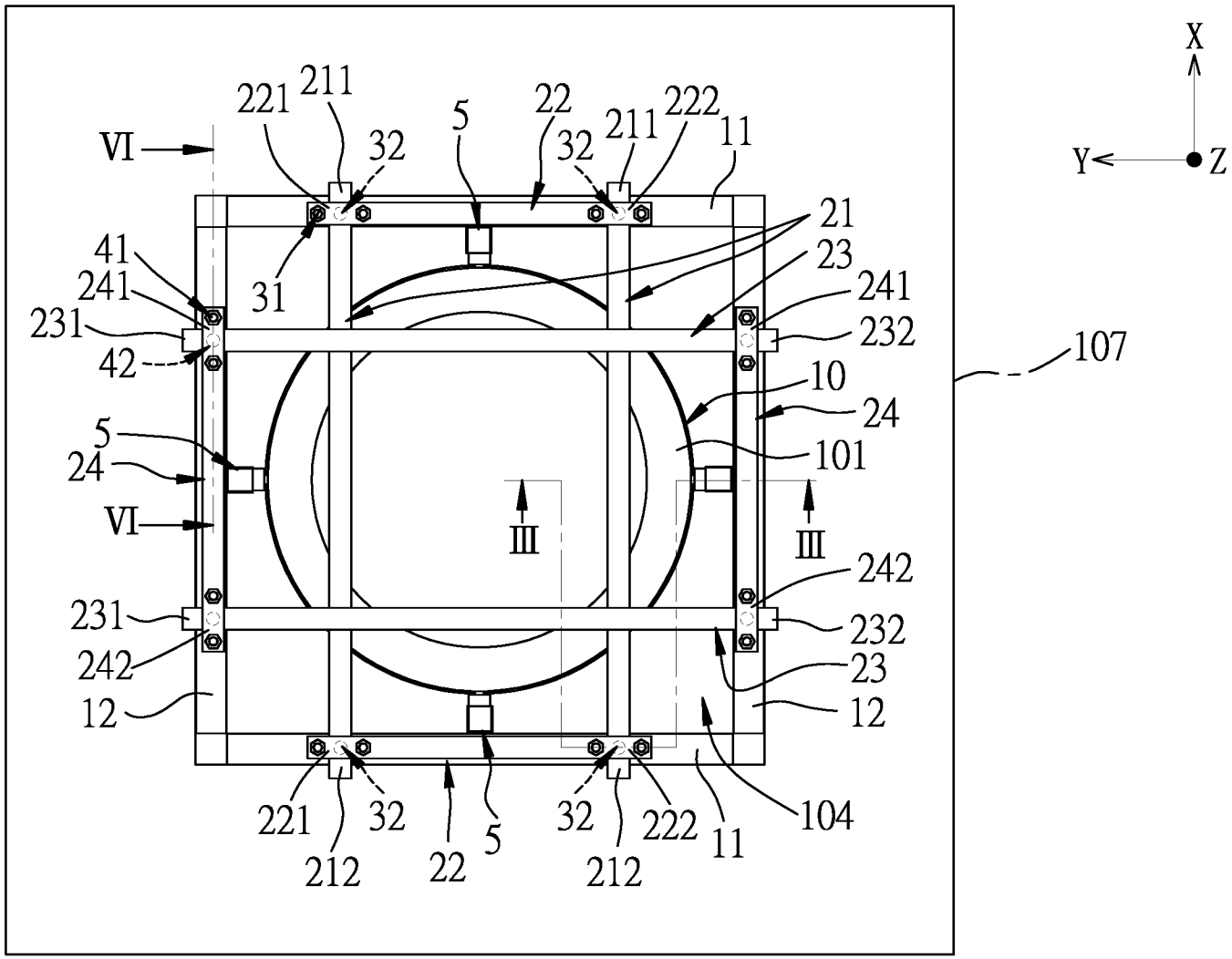
FIG. 2 is a top view of the shaft sinking apparatus.
Figure 3:
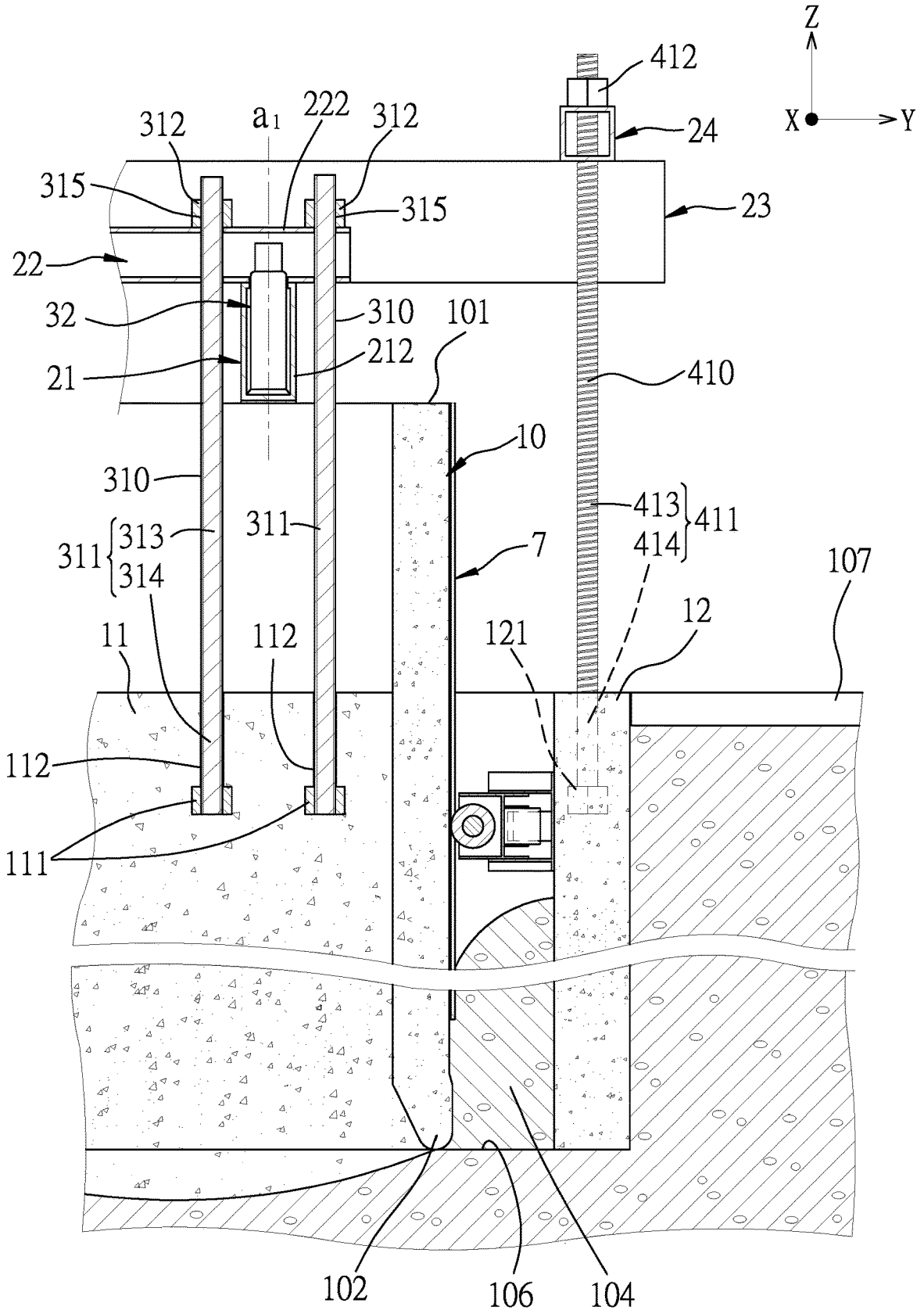
FIG. 3 is a fragmentary cross-sectional view taken along line III-III of FIG. 2.

Referring to FIGS. 1 to 3, a shaft sinking apparatus according to an embodiment of the disclosure is shown to include at least one first steel beam 21, two second steel beams 22, at least two first tightening units 31, and at least two first jack members 32. The shaft sinking apparatus is provided for sinking a concrete shaft 10 which has an upper surrounding edge 101 and a lower surrounding edge 102, and which is disposed on a bottom surface 106 of a pit 104 beneath a working platform 107. The pit 104 is located at an area for sinking the concrete shaft 10. In an embodiment, the pit 104 is made by excavating about 2 to 3 meters under the ground 103, followed by forming two first concrete walls 11 which are opposite to each other in a front-rear direction (X) and two second concrete walls 12 which are opposite to each other in a left-right direction (Y). Lateral surfaces of the first and second concrete walls 11, 12 serve as a portion of an inner peripheral surface of the pit 104, and top surfaces of the first and second concrete walls 11, 12 are co-planar with a concrete plate which is provided on the ground 103 to serve as the working platform 107.

The at least one first steel beam 21 extends in the front-rear direction (X), and is disposed on the upper surrounding edge 101 to span the concrete shaft 10.

The second steel beams 22 extend in the left-right direction (Y), and are disposed on the first steel beam 21 to be spaced apart from each other in the front-rear direction (X).

Each of the at least two first tightening units 31 is configured to tighten a respective one of the second steel beams 22 onto the first steel beam 21, and includes two first tightening bars 311 and two first tightening nuts 312. Each of the first tightening bars 311 has a first upper segment 313 with a first outer threaded surface 310, and a first lower segment 314 for being fastened to the working platform 107. The first upper segments 313 of the first tightening bars 311 of each of the first tightening units 31 extend in an upright direction (Z) through the respective second steel beam 22 to have the first steel beam 21 disposed therebetween. The first tightening nuts 312 are provided on the respective second steel beam 22, and respectively have two first inner threaded surfaces 315 configured to be brought respectively into threaded engagement with the first outer threaded surfaces 310 of the first upper segments 313 of the first tightening bars 311 so as to force the respective second steel beam 22 into abutment against the first steel beam 21.

Figure 4:
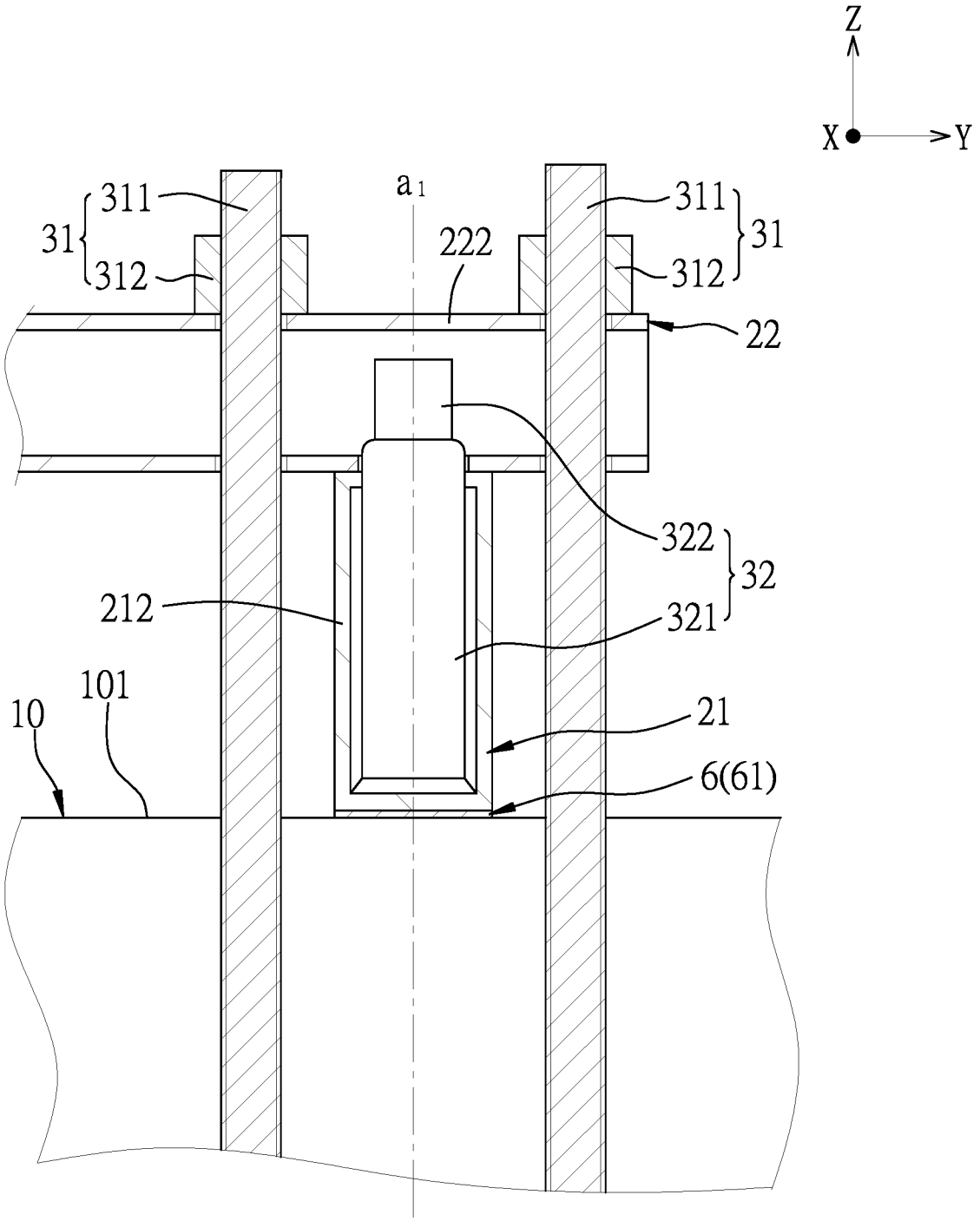
FIG. 4 is a fragmentary enlarged view of FIG. 3, illustrating a first jack member in a first retracted position.
Figure 5:
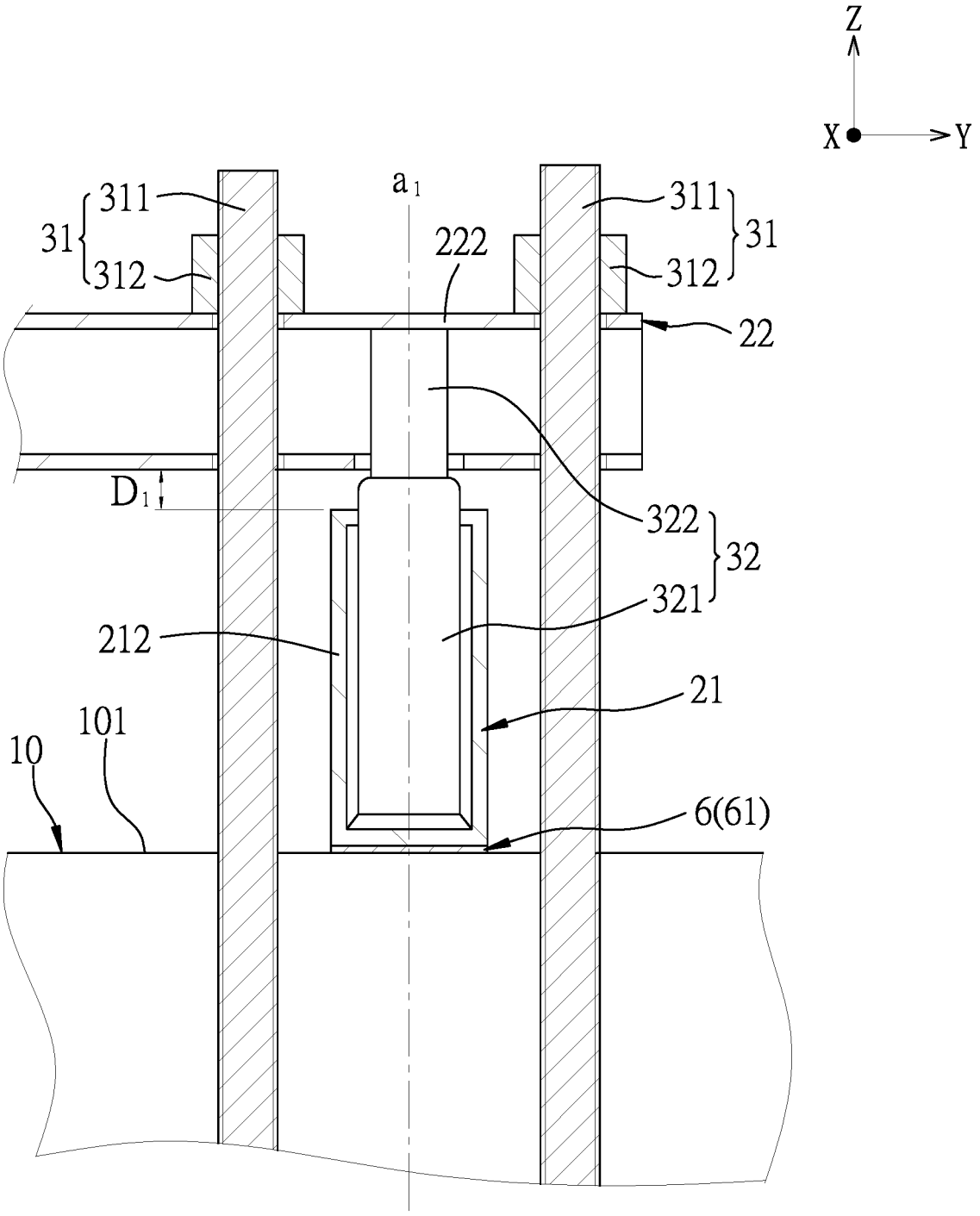
FIG. 5 is similar to FIG. 4 but illustrating the first jack member in a first extended position.

As shown in FIGS. 4 and 5, each of the first jack members 32 has a first cylinder 321 which is secured in the first steel beam 21, and a first piston rod 322 which is received in a respective one of the second steel beams 22 such that when the first piston rod 322 of each of the first jack members 32 is actuated to extend along a first axis ($a_1$) in the upright direction (Z) from a first retracted position (FIG. 4) to a first extended position (FIG. 5), the first steel beam 21 is driven by the first jack members 32 to move downwardly away from the second steel beams 22 by a distance ($D_1$), to thereby force the lower surrounding edge 102 of the concrete shaft 10 to sink into the bottom surface 106 of the pit 104. In an embodiment, each of the first jack members 32 is a hydraulic jack which may be actuated by any means known to the art (not shown).

In an embodiment shown in FIGS. 4 to 8, a shaft sinking apparatus may further include a pressed pad unit 6 which is disposed to fill gaps between the first steel beam 21 and the upper surrounding edge 101 of the concrete shaft 10.

In an embodiment shown in FIGS. 1 to 3, the shaft sinking apparatus may include two of the first steel beams 21, four of the first tightening units 31, and four of the first jack members 32.

The first steel beams 21 are spaced apart from each other in the left-right direction (Y). Each of the first steel beams 21 has a first front segment 211, a first rear segment 212, and a first middle segment 213 between the first front and rear segments 211, 212. The first middle segments 213 of the first steel beams 21 are disposed to span the concrete shaft 10 at the same level in the upright direction (Y). The first front and rear segments 211, 212 are located above the first concrete walls 11, respectively.

Each of the second steel beams 22 has a second left segment 221 and a second right segment 222, and is located above a respective one of the first concrete walls 11. The second left and right segments 221, 222 of a front one of the second steel beams 22 are respectively disposed on the first front segments 211 of the first steel beams 21. The second left and right segments 221, 222 of a rear one of the second steel beams 22 are respectively disposed on the first rear segments 212 of the first steel beams 21.

The first upper segments 313 of the first tightening bars 311 of each of the first tightening units 31 extend through a respective one of the second left and right segments 221, 222 of the second steel beams 22 to have a respective one of the first front and rear segments 211, 212 of the first steel beams 21 disposed therebetween. In each of the first tightening units 31, the first tightening nuts 312 are provided on a respective one of the second left and right segments 221, 222 of the second steel beams 22 to bring the first inner threaded surfaces 315 of the first tightening nuts 312 respectively into threaded engagement with the first outer threaded surfaces 310 of the first upper segments 313 of the first tightening bars 311 so as to force each of the second left and right segments 221, 222 of the second steel beams 22 into abutment against a respective one of the first front and rear segments 211, 212 of the first steel beams 21. In an embodiment shown in FIGS. 1 and 3, eight retaining holes 112 are formed in the first concrete walls 11. Eight first fastening nuts 111 (only two are shown) are respectively retained at bottoms of the retaining holes 112. Each of the first lower segments 314 of the first tightening rods 311 is inserted in a respective one of the retaining holes 112, and has an outer threaded surface configured to be brought into threaded engagement with an inner threaded surface of a corresponding one of the first fastening nuts 111 so as to fasten the first lower segment 314 to the working platform 107 through one of the first concrete walls 11.

As shown in FIGS. 2 to 5, in each of the first jack members 32, the first cylinder 321 is secured in a respective one of the first front and rear segments 211, 212 of the first steel beams 21, and the first piston rod 322 is received in a respective one of the second left and right segments 221, 222 of the second steel beams 22 so as to permit the first steel beams 21 to be evenly and simultaneously driven by the first jack members 32 to move downwardly away from the second steel beams 22, to thereby force the lower surrounding edge 102 of the concrete shaft 10 to evenly sink into the bottom surface 106 of the pit 104.

In an embodiment shown in FIGS. 4 to 8, the pressed pad unit 6 may include four pressed pads 61 disposed to fill four gaps among the first steel beams 21 and the upper surrounding edge 101 of the concrete shaft 10. Each of the pressed pads 61 may be made of a metal material with a relatively low hardness, such as but not limited to aluminum, lead, etc.

Figure 6:
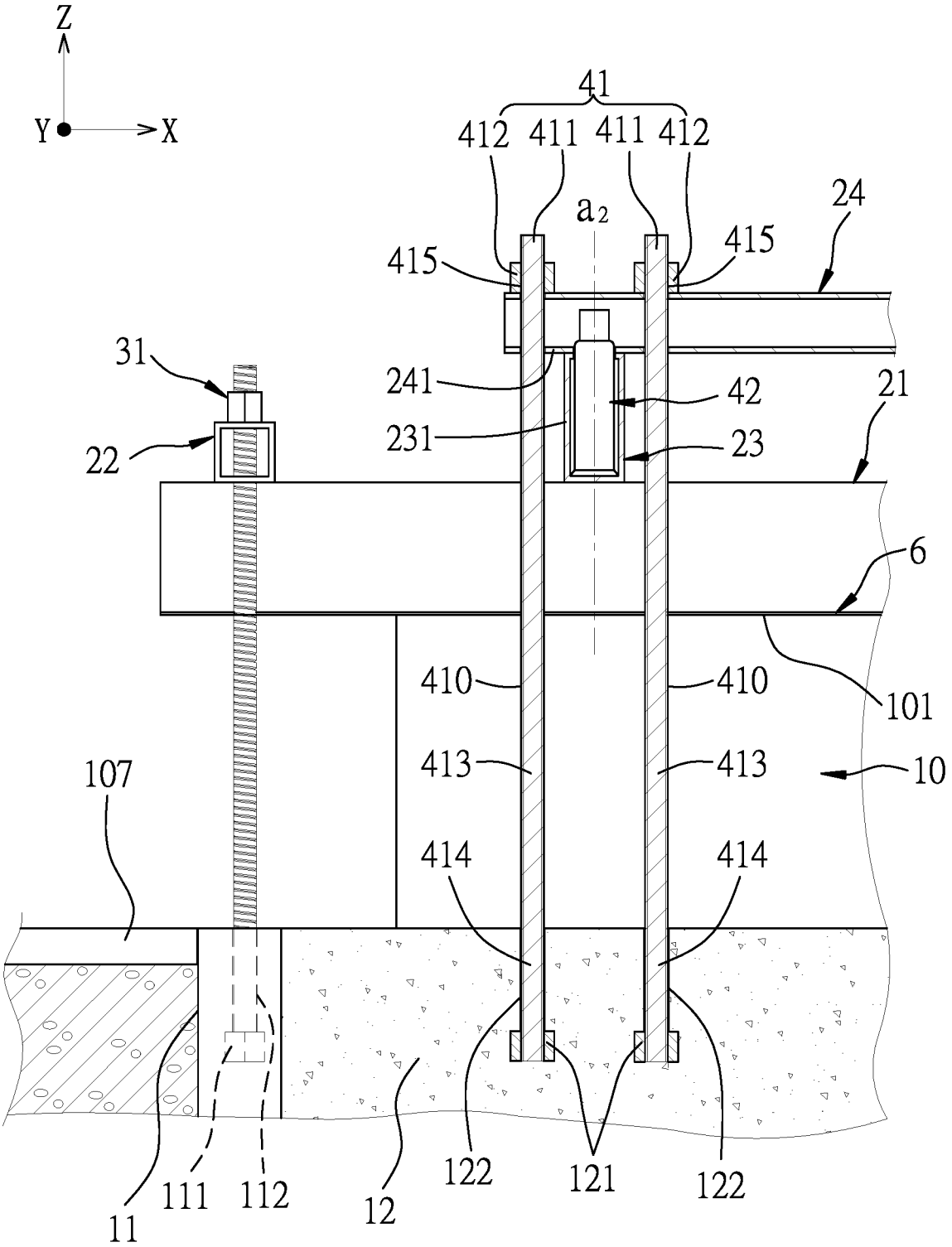
FIG. 6 is a fragmentary cross-sectional view taken along line VI-VI of FIG. 2.

In an embodiment shown in FIGS. 1, 2, and 6, the shaft sinking apparatus may further include two third steel beams 23, two fourth steel beams 24, four second tightening units 41, and four second jack members 42.

The third steel beams 23 are spaced apart from each other in the front-rear direction (X). Each of the third steel beams 23 extends in the left-right direction (Y), and has a third left segment 231, a third right segment 232, and a third middle segment 233 between the third left and right segments 231, 232. The third middle segments 233 of the third steel beams 23 are disposed to span the first middle segments 213 of the first steel beams 21 at the same level in the upright direction (Y). The third left and right segments 231, 232 are located above the second concrete walls 12, respectively.

The fourth steel beams 24 are spaced apart from each other in the left-right direction (Y) and are located above the second concrete walls 12, respectively. Each of the fourth steel beams 24 extends in the front-rear direction (X), and has a fourth front segment 241 and a fourth rear segment 242. The fourth front and rear segments 241, 242 of a left one of the fourth steel beams 24 are respectively disposed on the third left segments 231 of the third steel beams 23. The fourth front and rear segments 241, 242 of a right one of the fourth steel beams 24 are respectively disposed on the third right segments 232 of the third steel beams 23.

The second tightening units 41 are configured to tighten the fourth steel beams 24 onto the third steel beams 23, and each includes two second tightening bars 411 and two second tightening nuts 412.

Each of the second tightening bars 411 has a second upper segment 413 with a second outer threaded surface 410, and a second lower segment 414 for being fastened to the working platform 107. The second upper segments 413 of the second tightening bars 411 of each of the second tightening units 41 extend in the upright direction (Z) through a respective one of the fourth front and rear segments 241, 242 of the fourth steel beams 24 to have a corresponding one of the third left and right segments 231, 232 of the third steel beams 23 disposed therebetween. In an embodiment shown in FIGS. 1 and 6, eight retaining holes 122 are formed in the second concrete walls 12. Eight second fastening nuts 121 are respectively retained at the bottoms of the retaining holes 122. Each of the second lower segments 414 of the second tightening bars 411 is inserted in a respective one of the retaining holes 122, and has an outer threaded surface configured to be brought into threaded engagement with an inner threaded surface of a respective one of the second fastening nuts 121 so as to fasten the second lower segment 414 to the working platform 107 through one of the second concrete walls 12.

As shown in FIG. 6, in each of the second tightening units 41, the second tightening nuts 412 are provided on a respective one of the fourth front and rear segments 241, 242 of the fourth steel beams 24, and respectively have two second inner threaded surfaces 415 configured to be respectively brought into threaded engagement with the second outer threaded surfaces 410 of the second upper segment 413 of the second tightening bars 411 so as to force each of the fourth front and rear segments 241, 242 of the fourth steel beams 24 into abutment against a respective one of the third left and right segments 231, 232 of the third steel beams 23.

Each of the second jack members 42 has a second cylinder 421 which is secured in a respective one of the third left and right segments 231, 232 of the third steel beams 23, and a second piston rod 422 which is received in a respective one of the fourth front and rear segments 241, 242 of the fourth steel beams 24. When the second piston rod 422 of each of the second lack members 42 is actuated to extend along a second axis (a) in the upright direction (Z) from a second retracted position (FIG. 7) to a second extended position (FIG. 8), the third steel beams 23 are evenly and simultaneously driven by the second jack members 42 to move downwardly away from the fourth steel beams 24 by a distance ($D_2$), to thereby allow the concrete shaft 10 to be forced by the third steel beams 23, through the first steel beams 21, to further evenly sink into the bottom surface 106 of the pit 104. In an embodiment, each of the second jack members 42 is similar to the first jack members 32 and is a hydraulic jack.

In an embodiment shown in FIGS. 1 and 9 to 11, the shaft sinking apparatus may further include at least one pair of guiding units 5 which are configured for being mounted on the inner peripheral surface of the pit 104, and which are disposed opposite to each other in one of the front-rear direction (X) and the left-right direction (Y). Each of the guiding units 5 includes a base mount 51, a movable retainer 52, a third jack member 53, and a guide roller 54. As the guiding units 5 have identical structures, only one is referred to in the following description for the sake of brevity.

The base mount 51 is configured to be mounted on the inner peripheral surface of the pit 104, and defines a cavity 50 therein. In an embodiment, the base mount 51 is mounted on a respective one of the first concrete walls 11 or a respective one of the second concrete walls 12.

The movable retainer 52 is fitted slidably in the cavity 50, and has a proximate portion 521 and a distal portion 522 relative to the inner peripheral surface of the pit 104.

The third jack member 53 is disposed in the cavity 50 between the movable retainer 52 and the base mount 51, and has a third cylinder 531 and a third piston rod 532. The third cylinder 531 is secured to the proximate portion 521 of the movable retainer 52. The third piston rod 532 is coupled to the mount base 51 and is actuated to extend along a third axis ($a_3$) so as to permit the movable retainer 52 to be driven by the third jack member 53 to move from a proximate position (FIG. 10) to a distal position (FIG. 11) relative to the inner peripheral surface of the pit 104. In an embodiment, each of the third jack members 53 is similar to the first jack members 32, and is a hydraulic jack.

Figure 10:
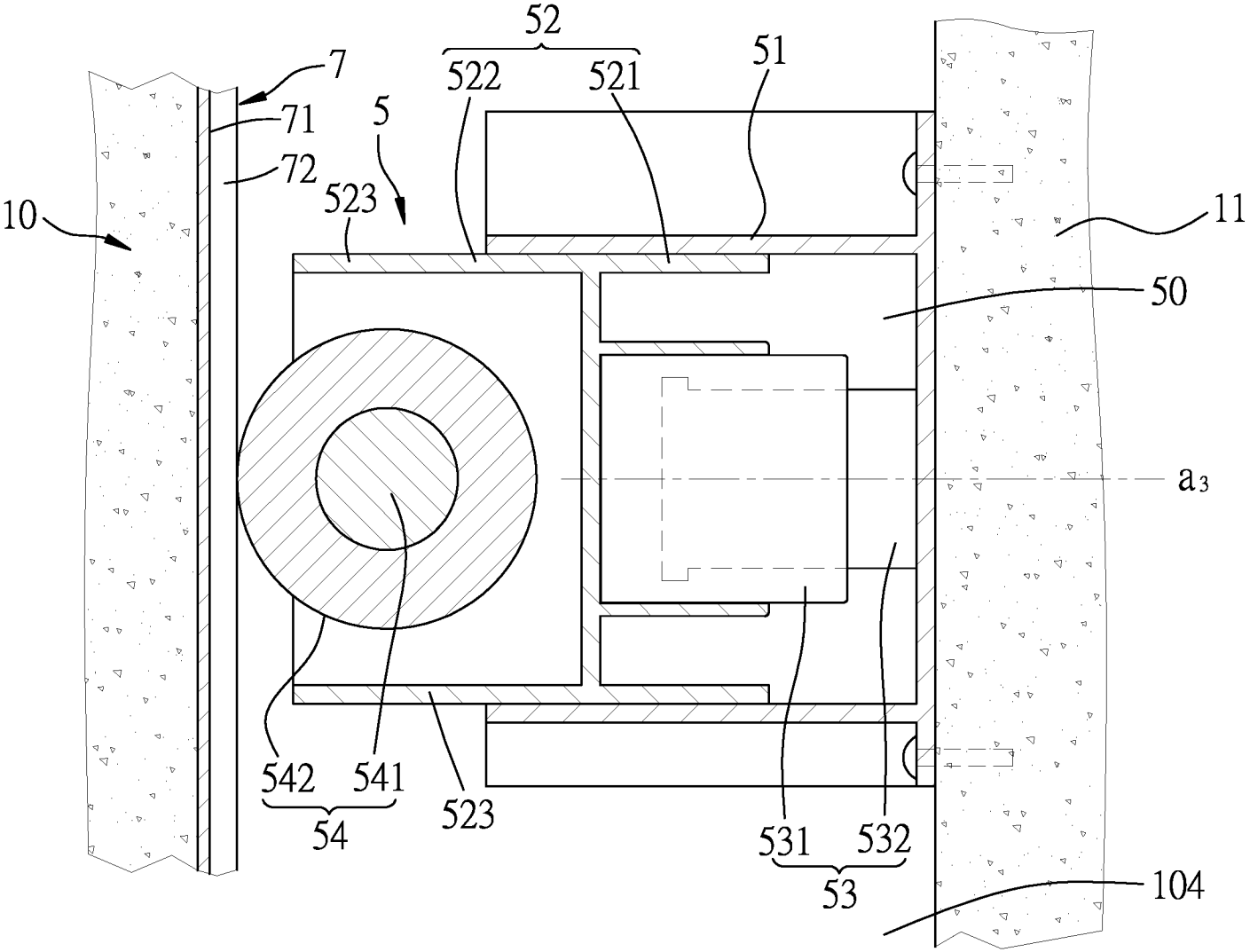
FIG. 10 is a fragmentary cross-sectional view taken along line X-X of FIG. 9, illustrating a guide roller of the guiding unit in a proximate position.
Figure 11:
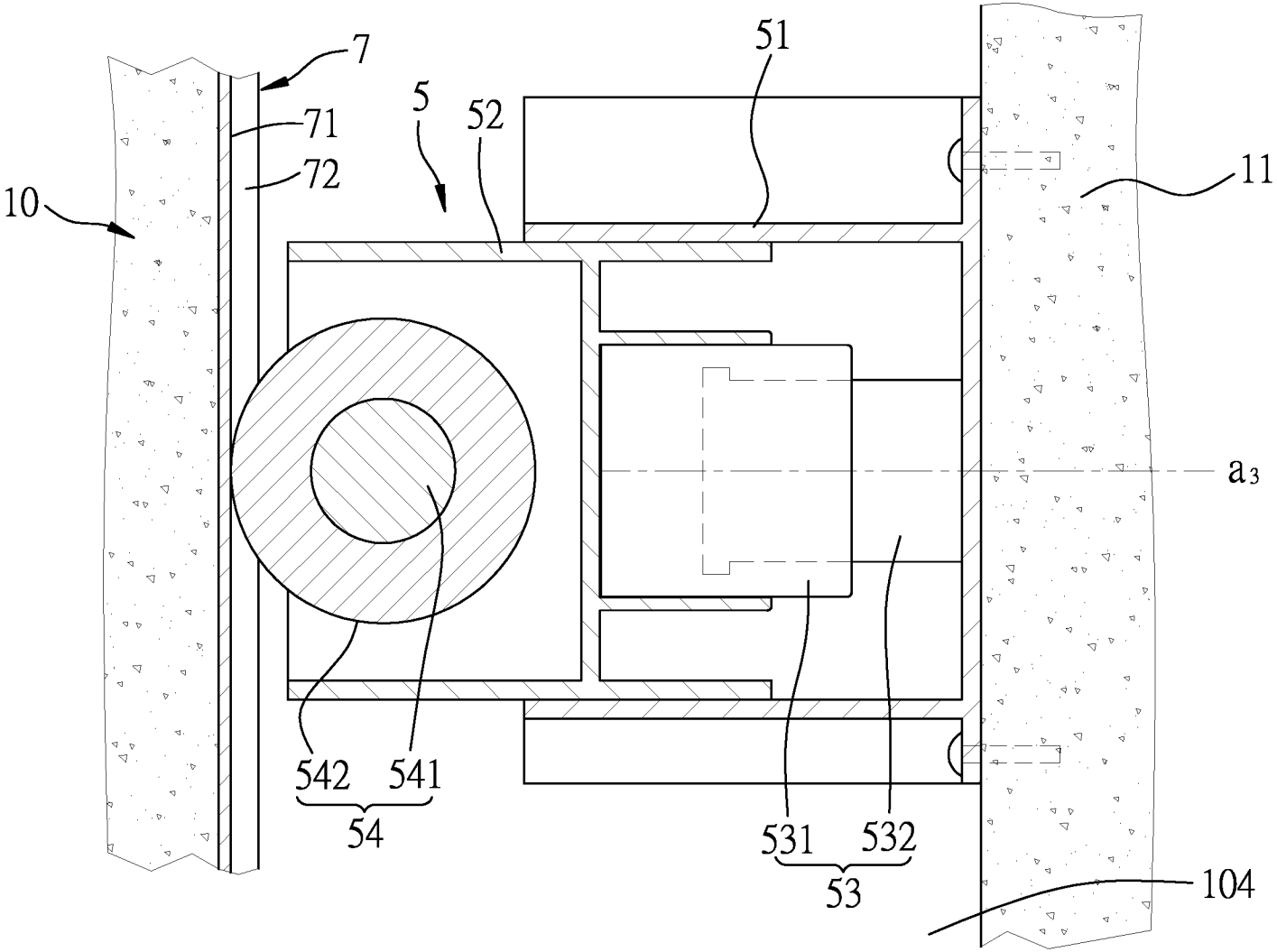
FIG. 11 is similar to FIG. 10 but illustrating the guide roller in a distal position.

The guide roller 54 is retained by the distal portion 522 of the movable retainer 52 and is configured for rolling contact with an outer peripheral surface of the concrete shaft 10 when the movable retainer 52 is in the distal position (FIG. 11). In an embodiment shown in FIGS. 9 and 10, the distal portion 522 of the movable retainer 52 may have two retaining walls 523, and the guide roller 54 may include a roller axle 541 retained between the retaining walls 523, and a roller body 542 mounted on the roller axle 541 for rolling contact with the outer peripheral surface of the concrete shaft 10.

In an embodiment shown in FIG. 2, the shaft sinking apparatus may include two pairs of the guiding units 5, one pair of which are opposite to each other in the front-rear direction (X), and the other pair of which are opposite to each other in the left-right direction (Y). Further, the guiding units 5 may be provided in proximity to the working platform 107.

In an embodiment shown in FIGS. 3, 10, and 11, four guided rails 7 may be provided on the outer peripheral surface of the concrete shaft 10 to permit the guide rollers 54 of the guiding units 5 to be in rolling contact with the outer peripheral surface of the concrete shaft 10 through the guided rails 7. Each of the guided rails 7 has an elongated U-shaped steel bar 71 with an elongated opening 72 configured to permit the guide roller 54 of a respective one of the guiding units 5 to roll on the elongated U-shaped steel bar 71 through the elongated opening 72.

With the provision of the guiding units 5 and the guided rails 7, the concrete shaft 10 may be evenly sink into the bottom surface 106 of the pit 104 in the upright direction (Z).

Figure 15:
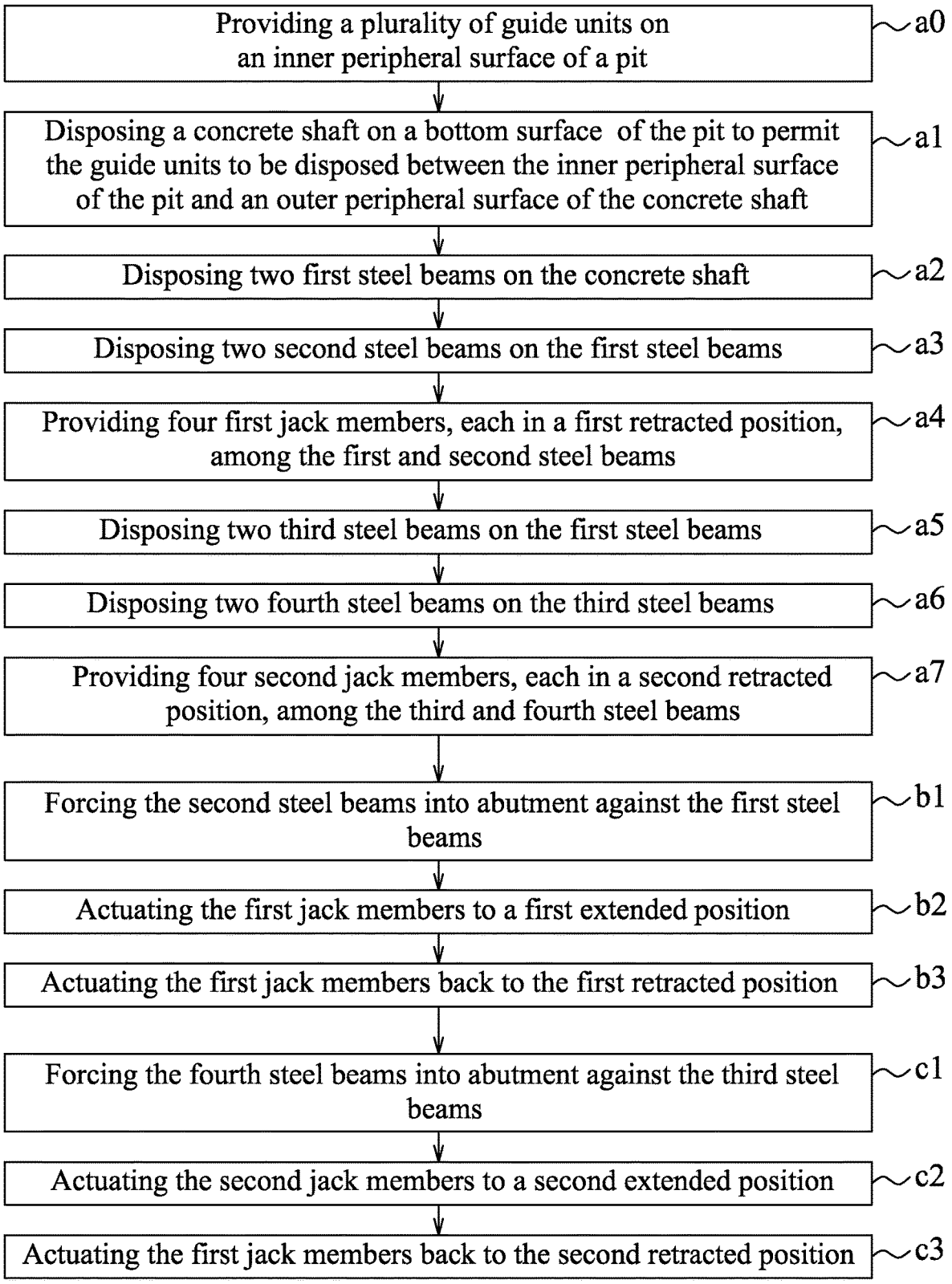
FIG. 15 is a flow diagram illustrating a method for sinking a concrete shaft according to an embodiment of the disclosure.

FIG. 15 illustrates a method for sinking the concrete shaft 10 according to an embodiment of the disclosure implemented using the shaft sinking apparatus disclosed above. The method may include steps a1) to a4) and steps b1) and b2).

Figure 12:
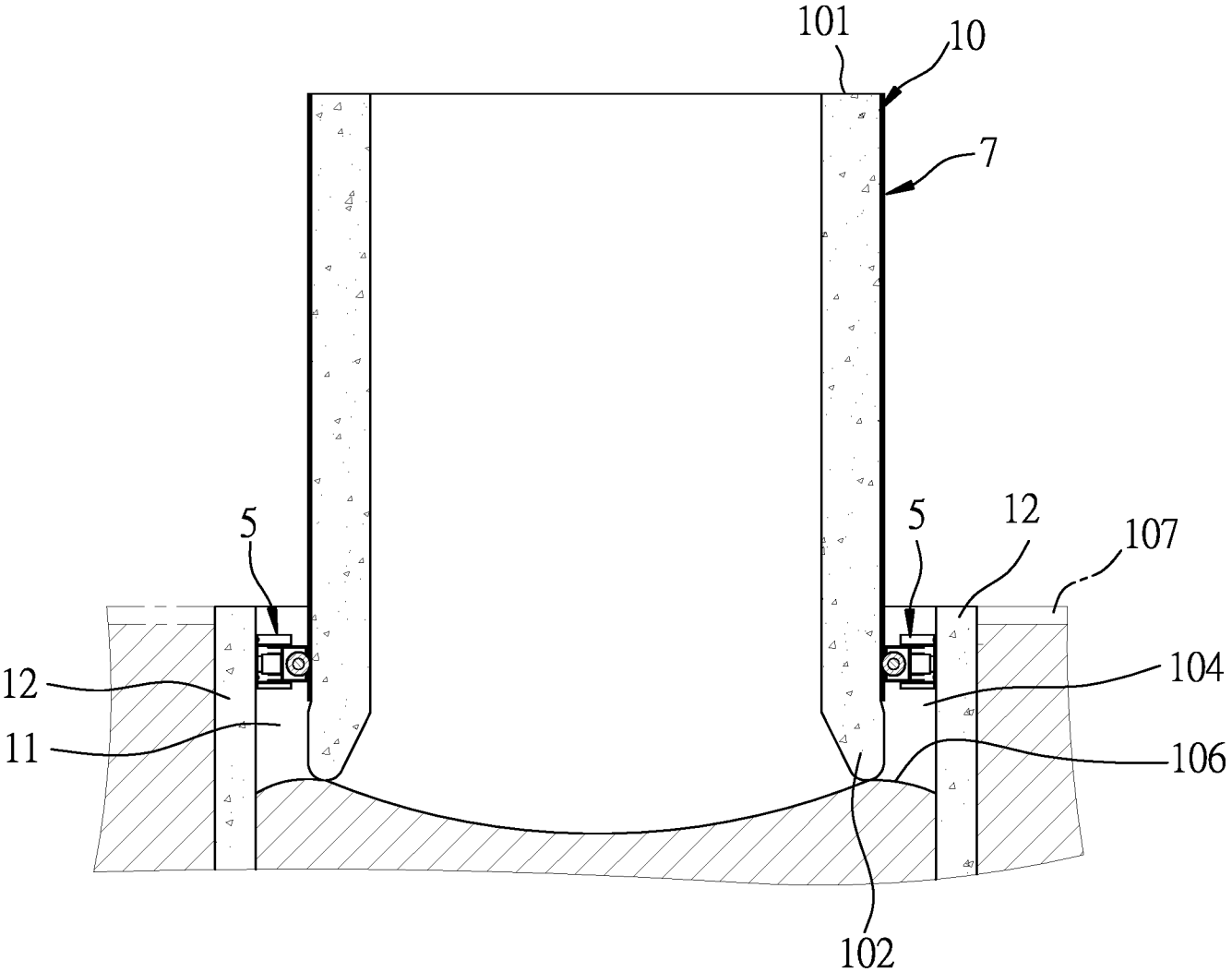
FIG. 12 is a fragmentary cross-sectional view illustrating the concrete shaft disposed on a bottom surface of a pit.

In step a1), as shown in FIG. 12, the concrete shaft 10 is disposed on the bottom surface 106 of the pit 104. After the concrete shaft 10 is disposed in the pit 104, the soil or the like underneath the concrete shaft 10 is excavated out through a central hollow portion of the concrete shaft 10 (see FIG. 12).

In step a2), the at least one first steel beam 21 is disposed on the upper surrounding edge 101 of the concrete shaft 10. In an embodiment shown in FIGS. 1 and 3, in step a2), two of the first steel beams 21 are disposed to permit the first middle segments 213 thereof to span the concrete shaft 10 at the same level in the upright direction (Y) in the way mentioned above. In addition, in step a2), the pressed pad unit 6 may be provided to fill the gaps among the first steel beams 21 and the upper surrounding edge 101 of the concrete shaft 10.

In step a3), the two second steel beams 22 are disposed on the at least one first steel beam 21. In an embodiment shown in FIGS. 1 and 3, in step a3), the second steel beams 22 are disposed on the first steel beams 21 in the wav mentioned above.

In step a4), the at least two first jack members 32 each of which is in the first retracted position (FIGS. 4 and 13) are provided. Steps a3) and a4) may be implemented at the same time. In an embodiment shown in FIGS. 1 and 2, in step a4), four of the first jack members 32 are provided among the first and second steel beams 21, 22 in the way mentioned above.

Step b1) is implemented after step a1) to a4). In step b1, the second steel beams 22 are forced into abutment against the first steel beam 21. In an embodiment shown in FIGS. 1, 13, and 15, in step b1), the second steel beams are forced into abutment against the first steel beams 21 using the four first tightening units 31 in the wav mentioned above.

Step b2) is implemented after step hi). In step b2), each of the first jack members 32 is actuated from the first retracted position (FIGS. 4 and 13) to the first extended position (FIGS. 5 and 14) so as to move the first steel beam 21 downwardly away from the second steel beams 22, to thereby force the lower surrounding edge 102 of the concrete shaft 10 to sink into the bottom surface 106 of the pit 104. In an embodiment shown in FIGS. 1, 3, 13, and 14, in step b2), the first steel beams 21 are evenly and simultaneously moved downwardly away from the second steel beams 22 in the way mentioned above.

In an embodiment shown in FIG. 15, the method may further include steps a5), a6), a7), c1), and c2).

Steps a5), a6), and a7) are implemented after steps a1) to a4).

In step a5), the third steel beams 23 are disposed on the first steel beams 21 in the way mentioned above.

In step a6), the fourth steel beams 24 are disposed on the third steel beams 23 in the way mentioned above.

In step a7), the four second jack members 42, each in the second retracted position (FIGS. 7 and 13), are provided among the third and fourth steel beams 23, 24 in the way mentioned above. In addition, steps a6) and a7) may be implemented at the same time.

Step c1) is implemented after steps a1) to a7). In step c), the fourth steel beams 24 are forced into abutment against the third steel beams 23 using the four second tightening units 41 in the way mentioned above.

Step c2) is implemented after step c1). In step c2), each of the second jack members 42 is actuated from the second retracted position (FIGS. 7 and 13) to the second extended position (FIGS. 8 and 14) so as to simultaneously move the third steel beams 23, together with the first steel beams 21, downwardly away from the fourth steel beams 24, to thereby force the concrete shaft 10 to further sink into the bottom surface 106 of the pit 104. After steps b2) and c2), the soil or the like beneath the concrete shaft 10 is further excavated out through the central hollow portion of the concrete shaft 10 (see FIG. 13).

In an embodiment shown in FIG. 15, the method may further include steps b3) and c3).

Figure 13:
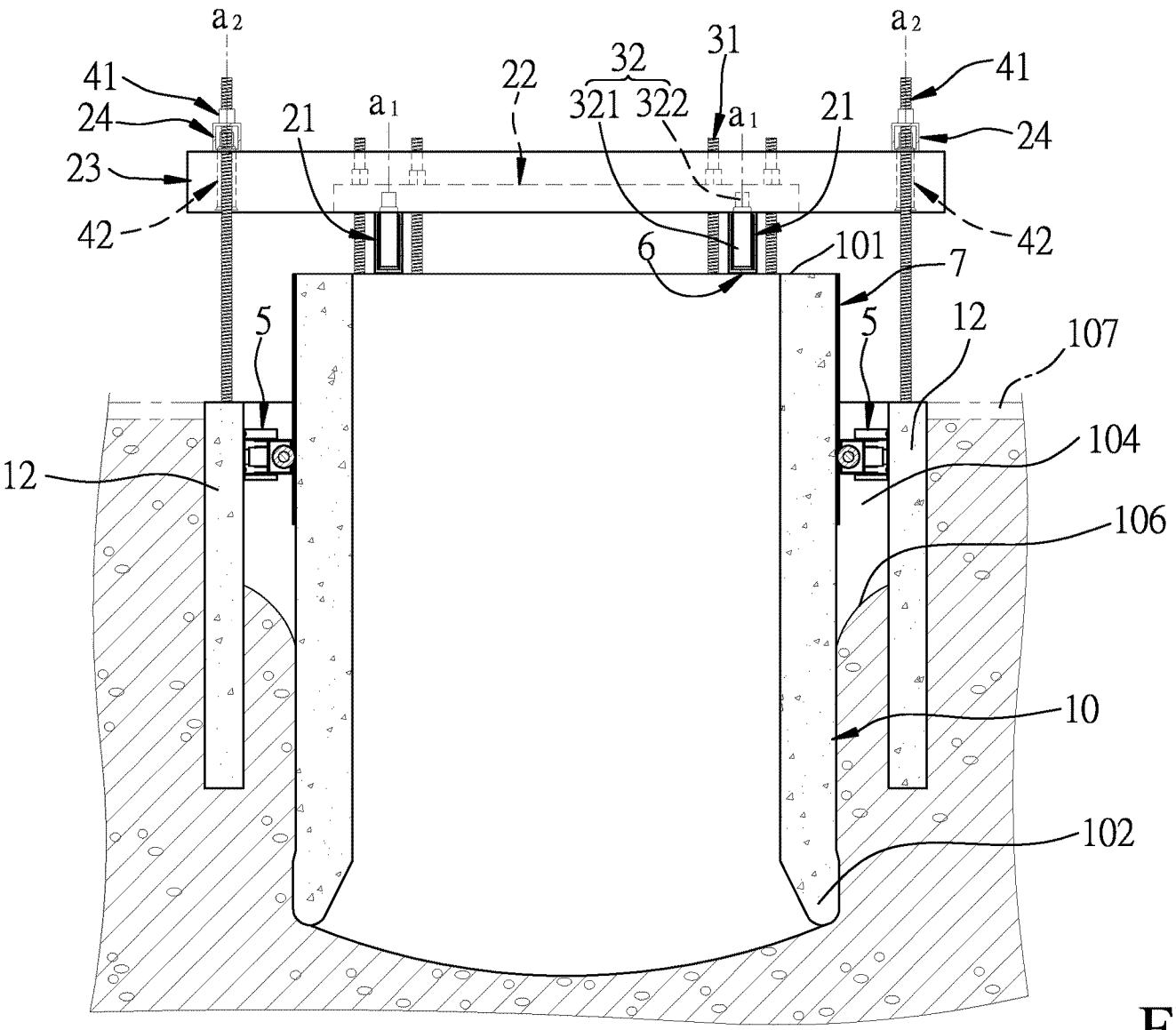
FIG. 13 is a fragmentary cross-sectional view illustrating a state of the concrete shaft after second steel beams and fourth steel beams are respectively in abutment against first steel beams and third steel beams, respectively.
Figure 14:
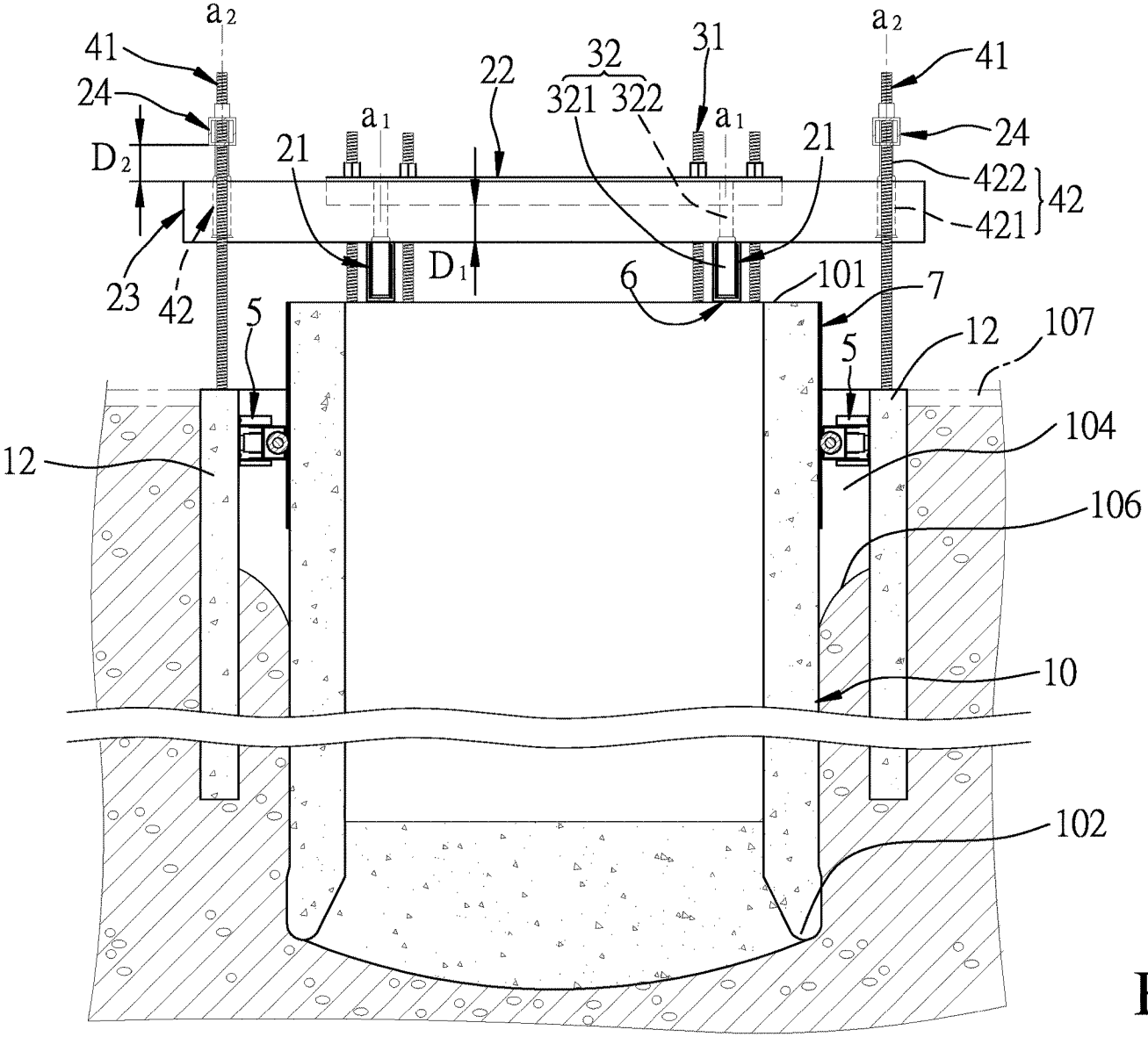
FIG. 14 is fragmentary cross-sectional view illustrating a state of the concrete shaft after the first jack members and the second jack members are respectively in the first extended position and the second extended position.

Step b3) is implemented after step b2). In step b3), each of the first jack members 32 is actuated back to the first retracted position (FIGS. 4 and 13).

Figure 7:
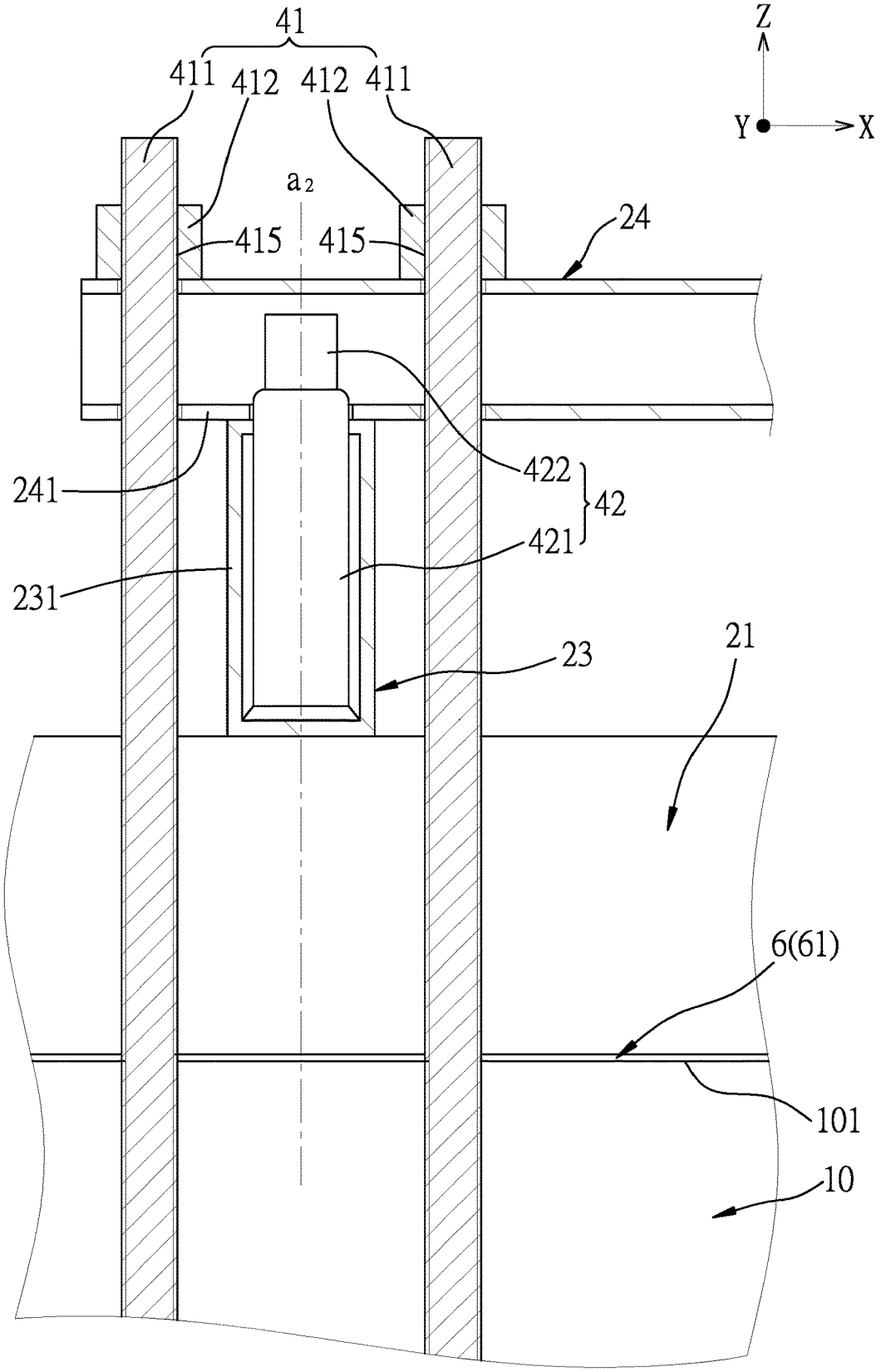
FIG. 7 is a fragmentary enlarged view of FIG. 6, illustrating a second jack member in a second retracted position.
Figure 8:
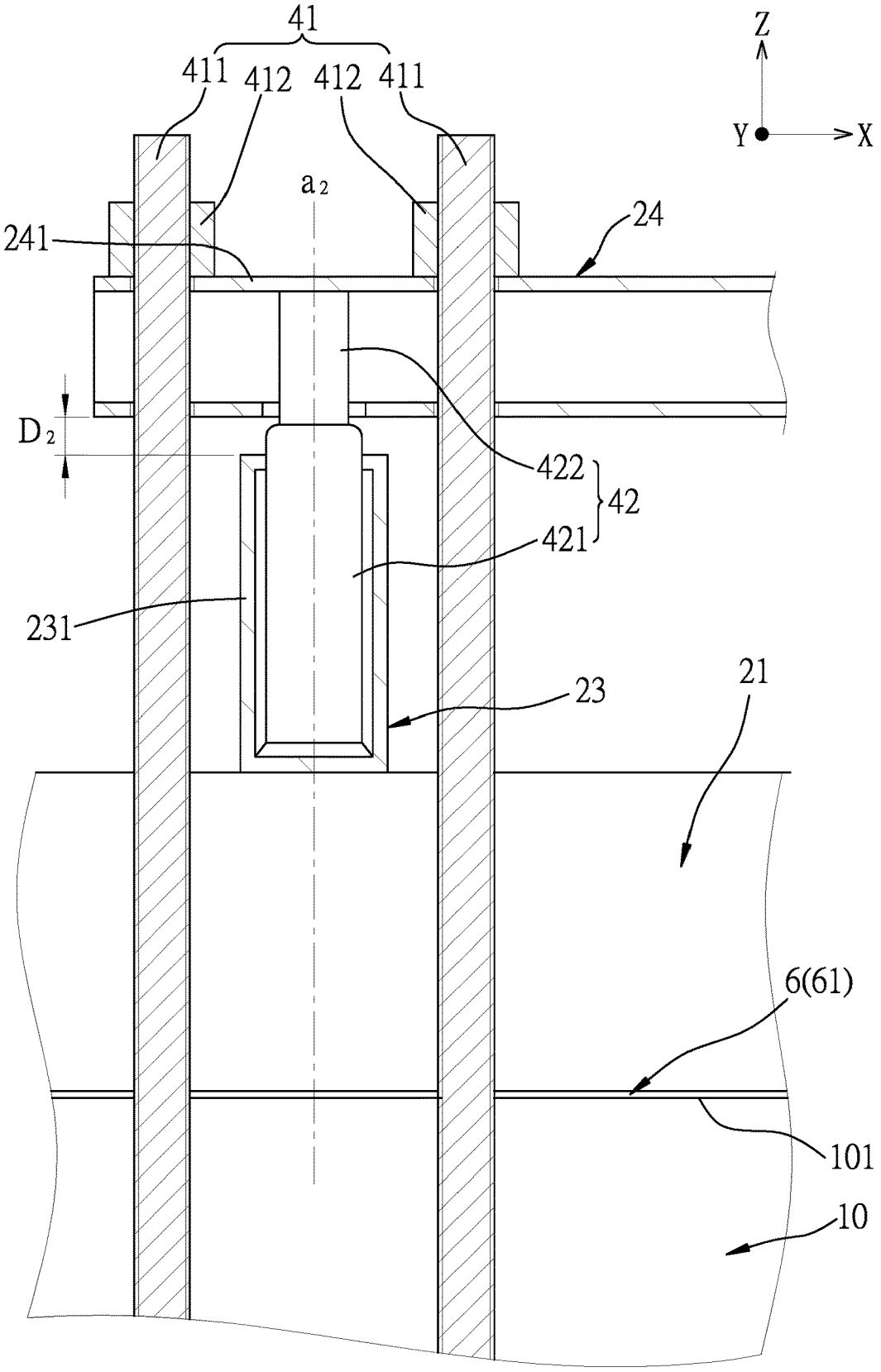
FIG. 8 is similar to FIG. 7 but illustrating the second jack member in a second extended position.
Figure 9:
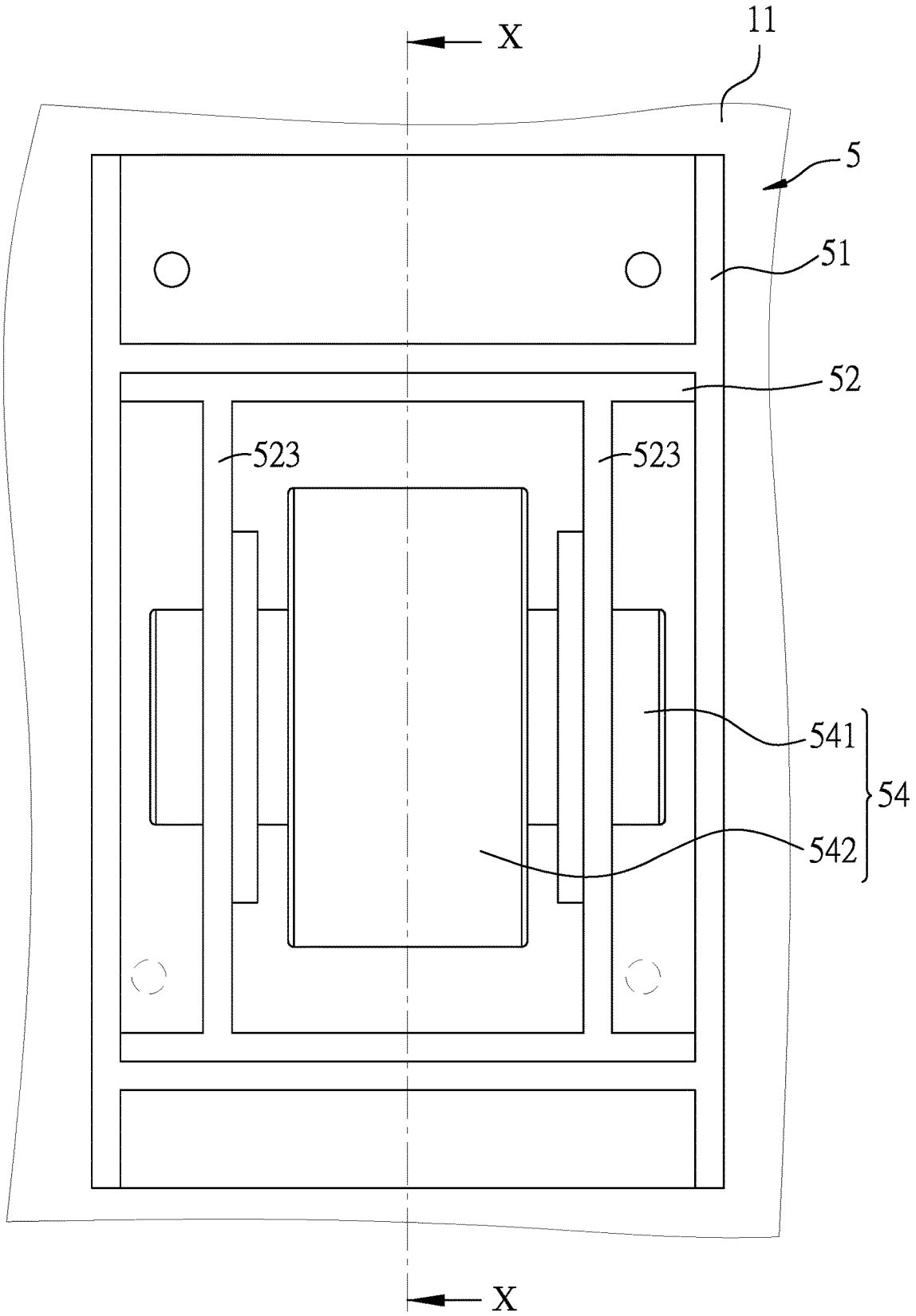
FIG. 9 is a fragmentary side view illustrating a guiding unit of the shaft sinking apparatus.

Step c3) is implemented after step c2). In step c3), each of the second jack members 42 is actuated back to the second retracted position (FIGS. 7 and 13).

For sinking the concrete shaft 10, steps b1), b2), and b3) are sequentially repeated and steps c1), c2), and c3) are sequentially repeated until a predetermined portion of the concrete shaft 10 is sunk into the bottom surface 106 of the pit 104. Please note that although in the embodiment shown in FIG. 15, steps b1) to b3) are implemented before steps c1) to c3), in other embodiment, steps b1) to b3) may be implemented after steps c1) to c3). After the predetermined portion of the concrete shaft 10 is sunk into the bottom surface 106 of the pit 104, a concrete material is poured into and cured in the central hollow portion of the concrete shaft 10 (see FIG. 14).

In an embodiment shown in FIGS. 12 and 15, before step a1), the method may further include step a0). In step a0), the guide units 5, which are angularly displaced from each other for being disposed between the inner peripheral surface of the pit 104 and the outer peripheral surface of the concrete shaft 10, are provided in the way mentioned above so as to guide the sinking of the concrete shaft 10 in steps b2) and c2) especially when the stratum beneath the bottom surface 106 of the pit 104 is relatively soft. In addition, the guided rails 7 may be provided on the outer peripheral surface of the concrete shaft 10 in the way mentioned above. The guided rails 7 may be shifted upward relative to the concrete shaft 10 after a portion of the concrete shaft 10 is sunk into the bottom surface 106 of the pit 104.

It should be noted that in this embodiment, the guiding units 5 are provided, and the concrete shaft 10 is disposed on the bottom surface 106 of the pit 104. In other not-shown embodiment in which the guiding units 5 are not provided, the concrete shaft 10 in step a1) may be disposed on an area which is surrounded by the working platform 107, and which is substantially at the same level in the upright direction (Y) as the ground 103.

With the provision of the shaft sinking apparatus of the disclosure, a portion of the concrete shaft 10 may be rapidly sunk into the bottom surface 106 of the pit 104 by repeating implementing steps Jo') to b3) and steps c1) to c3) of the method of the disclosure.

In the description above, for the purposes of explanation, numerous specific details have been set forth in order to provide a thorough understanding of the embodiment (s). It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects, and that one or more features or specific details from one embodiment may be practiced together with one or more features or specific details from another embodiment, where appropriate, in the practice of the disclosure.

While the disclosure has been described in connection with what is (are) considered the exemplary embodiment(s), it is understood that this disclosure is not limited to the disclosed embodiment(s) but is intended to cover various arrangements included within the spirit and scope of the broadest interpretation so as to encompass all such modifications and equivalent arrangements.

What is claimed is:

1. A shaft sinking apparatus for sinking a concrete shaft which has an upper surrounding edge and a lower surrounding edge, and which is disposed on a bottom surface of a pit beneath a working platform, said shaft sinking apparatus comprising:

at least one first steel beam extending in a front-rear direction, and for being disposed on the upper surrounding edge to span the concrete shaft;

two second steel beams extending in a left-right direction, and disposed on said first steel beam to be spaced apart from each other in the front-rear direction;

at least two first tightening units each of which is configured to tighten a respective one of said second steel beams onto the first steel beam, and each of which includes two first tightening bars each having a first upper segment with a first outer threaded surface, and a first lower segment for being fastened to the working platform, said first upper segments of said first tightening bars extending in an upright direction through said respective second steel beam to have said first steel beam disposed therebetween, and two first tightening nuts which are provided on of said respective second steel beam, and which respectively have two first inner threaded surfaces configured to be brought respectively into threaded engagement with said first outer threaded surfaces of said first upper segments of said first tightening bars so as to force said respective second steel beam into abutment against said first steel beam; and at least two first jack members each having a first cylinder which is secured in said first steel beam, and a first piston rod which is received in a respective one of said second steel beams such that when said first piston rod of each of said first jack members is actuated to extend along a first axis in the upright direction from a first retracted position to a first extended position, said first steel beam is driven by said first jack members to move downwardly away from said second steel beams, to thereby force the lower surrounding edge of the concrete shaft to sink into the bottom surface of the pit.

2. The shaft sinking apparatus according to claim 1, which comprises two of said first steel beams, four of said first tightening units, and four of said first jack members, wherein said first steel beams are spaced apart from each other in the left-right direction, each of said first steel beams having a first front segment, a first rear segment, and a first middle segment between said first front and rear segments, said first middle segments of said first steel beams being disposed to span the concrete shaft at the same level in the upright direction;

wherein each of said second steel beams has a second left segment and a second right segment, said second left and right segments of a front one of said second steel beams being respectively disposed on said first front segments of said first steel beams, said second left and right segments of a rear one of said second steel beams being respectively disposed on said first rear segments of said first steel beams;

wherein, for each of said first tightening units 31, said first upper segments of said first tightening bars extend through a respective one of said second left and right segments of said second steel beams to have a respective one of said first front and rear segments of said first steel beams disposed therebetween, said first tightening nuts being provided on a respective one of said second left and right segments of said second steel beams to bring said first inner threaded surfaces of said first tightening nuts respectively into threaded engagement with said first outer threaded surfaces of said first upper segments of said first tightening bars so as to force each of said second left and right segments 221, 222 of said second steel beams 22 into abutment against a respective one of said first front and rear segments of said first steel beams;

wherein, in each of said first jack members, said first cylinder is secured in a respective one of said first front and rear segments of said first steel beams, and said first piston rod is received in a respective one of said second left and right segments of said second steel beams so as to permit said first steel beams to be evenly and simultaneously driven by said first jack members to move downwardly away from said second steel beams, to thereby force the lower surrounding edge of the concrete shaft to evenly sink into the bottom surface of the pit.

3. The shaft sinking apparatus according to claim 2, further comprising:

two third steel beams spaced apart from each other in the front-rear direction, each of said third steel beams extending in the left-right direction and having a third left segment, a third right segment, and a third middle segment between said third left and right segments, said third middle segments of said third steel beams being disposed to span said first middle segments of said first steel beams at the same level in the upright direction;

two fourth steel beams spaced apart from each other in the left-right direction, each of said fourth steel beams extending in the front-rear direction, and having a fourth front segment and a fourth rear segment, said fourth front and rear segments of a left one of said fourth steel beams being respectively disposed on said third left segments of said third steel beams, said fourth front and rear segments of a right one of said fourth steel beams being respectively disposed on said third right segments of said third steel beams;

four second tightening units configured to tighten said fourth steel beams onto said third steel beams, each of said second tightening units including two second tightening bars each having a second upper segment with a second outer threaded surface, and a second lower segment for being fastened to the working platform, said second upper segments of said second tightening bars extending in the upright direction through a respective one of said fourth front and rear segments of said fourth steel beams to have a respective one of said third left and right segments of said third steel beams disposed therebetween, and two second tightening nuts which are provided on the respective one of said fourth front and rear segments of said fourth steel beams, and which respectively have two second inner threaded surfaces configured to be respectively brought into threaded engagement with said second outer threaded surfaces of said second upper segment of said second tightening bars so as to force each of said fourth front and rear segments of said fourth steel beams into abutment against a respective one of said third left and right segments of said third steel beams; and four second jack members each having a second cylinder which is secured in a respective one of said third left and right segments of said third steel beams, and a second piston rod which is received in a respective one of said fourth front and rear segments of said fourth steel beams such that when said second piston rod of each of said second jack members is actuated to extend along a second axis in the upright direction from a second retracted position to a second extended position, said third steel beams are evenly and simultaneously driven by said second jack members to move downwardly away from said fourth steel beams, to thereby allow the concrete shaft to be forced by said third steel beams, through said first steel beams, to further evenly sink into the bottom surface of the pit.

4. The shaft sinking apparatus according to claim 3, further comprising at least one pair of guiding units which are configured for being mounted on an inner peripheral surface of the pit, and which are disposed opposite to each other in one of the front-rear direction and the left-right direction, each of said guiding units including a base mount configured to be mounted on the inner peripheral surface of the pit, and defining a cavity therein, a movable retainer fitted slidably in said cavity, and having a proximate portion and a distal portion relative to the inner peripheral surface of the pit, a third jack member disposed in said cavity between said movable retainer and said base mount, and having a third cylinder which is secured to the proximate portion of said movable retainer, and a third piston rod which is coupled to said mount base and which is actuated to extend along a third axis so as to permit said movable retainer to be driven by said third jack member to move from a proximate position to a distal position relative to the inner peripheral surface of the pit, and a guide roller retained by the distal portion of said movable retainer and configured for rolling contact with an outer peripheral surface of the concrete shaft when said movable retainer is in the distal position.

5. The shaft sinking apparatus according to claim 4, which comprises two pairs of said guiding units, one pair of which are opposite to each other in the front-rear direction, and the other pair of which are opposite to each other in the left-right direction.

6. The shaft sinking apparatus according to claim 1, further comprising a pressed pad unit which is disposed to fill gaps between said first steel beam and the upper surrounding edge of the concrete shaft.

7. A method for sinking a concrete shaft, comprising the steps of:

a1) disposing the concrete shaft on a bottom surface of a pit;

a2) disposing at least one first steel beam on an upper surrounding edge of the concrete shaft to permit the first steel beam to span the concrete shaft in a front-rear direction;

a3) disposing two second steel beams, which extend in a left-right direction and which are spaced apart from each other in the front-rear direction, on the first steel beam;

a4) providing at least two first jack members each of which is in a first retracted position, and each of which has a first cylinder secured in the first steel beam, and a first piston rod received in a respective one of the second steel beams, the first piston rod being actuatable to extend along a first axis in an upright direction from the first retracted position to a first extended position;

b1) after steps a1), a2), a3, and a4), forcing the second steel beams into abutment against the first steel beam; and b2) after step b1), actuating each of the first jack members from the first retracted position to the first extended position so as to move the first steel beam downwardly away from the second steel beams, to thereby force a lower surrounding edge of the concrete shaft to sink into the bottom surface of the pit.

8. The method according to claim 7, wherein, in step a2), two of the first steel beams, which are spaced apart from each other in the left-right direction, are disposed on the upper surrounding edge of the concrete shaft, each of the first steel beams having a first front segment, a first rear segment, and a first middle segment between the first front and rear segments, the first middle segments being disposed to span the concrete shaft at the same level in the upright direction;

wherein, in step a3), the second steel beams are disposed on the first steel beams, each of the second steel beams having a second left segment and a second right segment, the second left and right segments of a front one of the second steel beams being respectively disposed on the first front segments of the first steel beams, the second left and right segments of a rear one of the second steel beams being respectively disposed on the first rear segments of the first steel beams;

wherein, in step a4), four of the first lack members are provided, and in each of which the first cylinder is secured in a respective one of the first front and rear segments of the first steel beams, and the first piston rod is received in a respective one of the second left and right segments of the second steel beams;

wherein, in step b1), the second steel beams are forced into abutment against the first steel beams; and wherein, in step b2), the first steel beams are evenly and simultaneously moved downwardly away from the second steel beams.

9. The method according to claim 8, further comprising steps of:

a5) disposing two third steel beams on the first steel beams to permit the third steel beams to extend in the left-right direction and to be spaced apart from each other in the front-rear direction, each of the third steel beams having a third left segment, a third right segment, and a third middle segment between the third left and right segments, the third middle segments of the third steel beams being disposed to span the first middle segments of the first steel beams at the same level in the upright direction;

a6) disposing two fourth steel beams on the third steel beams to permit the fourth steel beams to extend in the front-rear direction and to be spaced apart from each other in the left-right direction, each of the fourth steel beams having a fourth front segment and a fourth rear segment, the fourth front and rear segments of a left one of the fourth steel beams being respectively disposed on the third left segments of the third steel beams, the fourth front and rear segments of a right one of the fourth steel beams being respectively disposed on the third right segments of the third steel beams;

a7) providing four second jack members each of which is in a second retracted position, and each of which has a second cylinder secured in a respective one of the third left and right segments of the third steel beams, and a first piston rod received in a respective one of the fourth front and rear segments of the fourth steel beams, the second piston rod being actuatable to extend along a second axis in an upright direction from the second retracted position to a second extended position;

c1) after steps a1), a2), a3), a4), a5), a6), and a7), forcing the fourth steel beams into abutment against the third steel beams; and c2) after step c1), actuating each of the second jack members from the second retracted position to the second extended position so as to simultaneously move the third steel beams, together with the first steel beams, downwardly away from the fourth steel beams, to thereby force the concrete shaft to further sink into the bottom surface of the pit.

10. The method according to claim 9, further comprising the steps of:

b3) after step b2), actuating each of the first jack members back to the first retracted position; and c3) after step c2), actuating each of the second jack members back to the second retracted position, wherein steps b1), b2), and b3) are sequentially repeated and steps c1), c2), and c3) are sequentially repeated until a predetermined portion of the concrete shaft is sunk into the bottom surface of the pit.

11. The method according to claim 9, further comprising a step of a0) before step a1), providing a plurality of guide units which are angularly displaced from each other for being disposed between an inner peripheral surface of the pit and an outer peripheral surface of the concrete shaft, each of the guide units having a guide roller for rolling contact with the outer peripheral surface of the concrete shaft so as to guide the sinking of the concrete shaft in steps b2) and c2).

* * * * *